United States Patent [19]

Underhill

[11] Patent Number: 4,612,673

[45] Date of Patent: Sep. 23, 1986

[54] PATIENT GOWN

[76] Inventor: Kim Underhill, 1311 NE 26th Ave., Pompano Beach, Fla. 33062

[21] Appl. No.: 688,074

[22] Filed: Dec. 31, 1984

[51] Int. Cl.[4] ..... A41B 9/00

[52] U.S. Cl. ..... 2/114; 2/DIG. 7; 2/DIG. 6

[58] Field of Search ..... 2/114, DIG. 7, DIG. 6, 2/69

[56] References Cited

U.S. PATENT DOCUMENTS

D. 233,634 11/1974 Snider ..... 2/DIG. 7

4,055,855 11/1977 Rayone et al. ..... 2/114

4,422,186 12/1983 Loney ..... 2/114

*Primary Examiner*—Doris L. Troutman

*Attorney, Agent, or Firm*—Jack E. Dominik

[57] ABSTRACT

A patient gown having a single body portion which is enclosed by removably secured fasteners at either the anterior or posterior portion, a V-neck is provided in both the front and the rear, and a pair of shoulder elements are secured to the upper portion of the body, each of which is removably securable at the top so that the entire shoulder can be opened.

3 Claims, 5 Drawing Figures

PATIENT GOWN

BACKGROUND OF THE INVENTION

1. Field of the Invention

The present invention relates to patient gowns, and more particularly that type of gown which is worn by a patient in the hospital, and which is changed daily, and may be open from time to time for inspection of the body or other treatment.

2. Summary of the Prior Art

The prior art is exemplified by design U.S. Pat. No. Des. 233,634 as well as U.S. Pat Nos. 2,556,931; 2,701,364; 3,154,789; and 3,745,587. The bulk of the prior-art gowns as used are closed by string ties, normally at an opening in the rear portion. Some modifications appear such as the disposable examination garment disclosed in Lewis patent No. 3,154,789. That gown, however, is for the purpose of examination and dose not cover the body to the extent required. U.S. Pat. No. Des. 233,634 discloses a gown which also includes an open shoulder, but the gown itself is tied, and is tied posteriorly. Similarly the gown shown in Miller U.S. Pat. No. 2,556,931 is tied or otherwise secured in the posterior portion.

A more complete illustration of the tubular-type "Mother Hubbard" gown is shown in U.S. Pat. No. 3,745,587. There it will be noted that it is intended to be a disposable gown and not reusable. Also to be noted is that it is secured throughout the entire construction, and tied in the rear.

It is highly desirable when utilizing intravenous feeds to a patient to be able to open up the hospital gown at the front portion and inspect the insertion. In addition, with a nursing mother, it is highly desirable to be able to drop a portion of the gown for purposes of nursing, and then replace the same all being done by the mother without assistance. Many other post-operative applications require inspection of the patient from time to time in the area of the wound. Cardiac catheter administration in particular requires exposing the chest from time to time. It is desirable not to have to open up the entire gown, or lift it from its position adjacent the knees all the way up to the abdomen for inspecting an abdominal incision.

SUMMARY OF THE INVENTION

The present invention is directed to a patient gown having a single body portion which is enclosed by removably secured fasteners at either the anterior or posterior portion. A V-neck is provided in both the front and the rear, and a pair of shoulder elements are secured to the upper portion of the body, each of which is removably securable at the top so that the entire shoulder can be opened.

In view of the foregoing it is a principal object of the present invention to provide a patient gown which has an anterior opening, and which eliminates strings which are used for securing which, in the normal mode, are at the patient's back and will cause pressure points while in bed.

Still another object of the present invention is to provide an anterior opening hospital gown with adequate closure so that the back portion of the patient is not exposed, and a second gown for purposes of privacy is not required while the patient is ambulatory in the hospital.

Still another object of the present invention is to provide the patient gown which, when opened anteriorly and at the shoulders, permits the same to be slipped out from underneath the patient and another fresh gown applied to the patient utilizing the same techniques.

Still another object of the present invention is to provide a patient gown which, because tie strings are eliminated, is easier to launder and will have longer life. Snaps may be used, but they can be lost in laundring and distort Xrays.

Yet another important aspect of the present invention is that it can be reversed where a posterior opening or plurality of posterior openings is required. Similarly, because there are a minimum of three openings in the front, various portions of the body can be examined without removing the entirety of the gown at its anterior portion.

Yet another object of the present invention is to achieve all of the above advantages with a gown which is inexpensive to manufacture and durable in use. One economy factor results from cutting from a bolt of cloth with the bottom of the gown on a finished edge and the end of the sleeve on a finished edge. As a result the labor and material to make a hem is omitted with a corresponding cost saving.

BRIEF DESCRIPTION OF THE DRAWINGS

Further objects and advantages of the present invention will become apparent as the following description of an illustrative embodiments takes place, in which.

DESCRIPTION OF A PREFERRED EMBODIMENT

Figure 1:
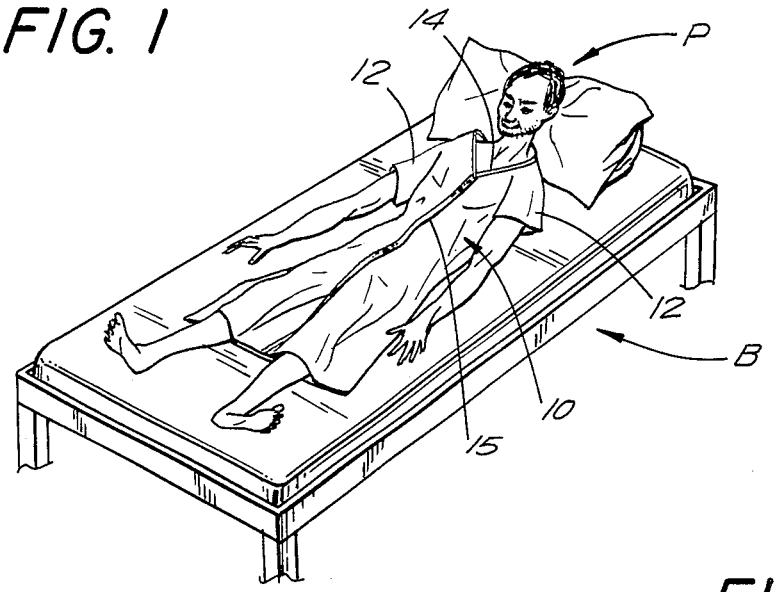
FIG. 1 is a perspective view of a patient P in a hospital bed B to which the subject gown has been applied.
Figure 2:
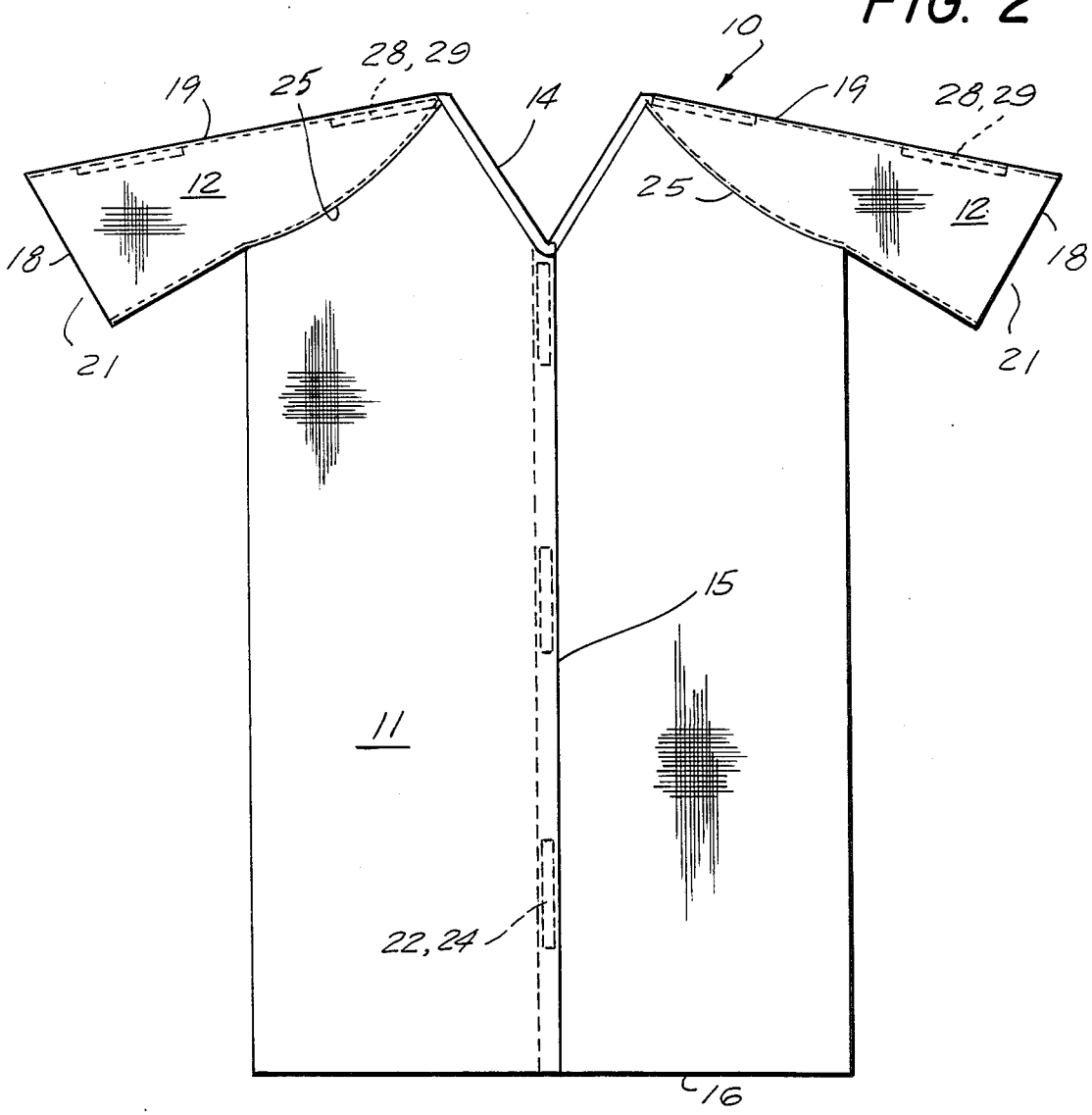
FIG. 2 is a front elevation of the subject gown.

As shown in FIG. 1, a patient P is lying on a bed B, and is wearing the illustrative patient gown 10. As shown in both FIGS. 1 and 2, the illustrative gown 10 includes a body portion 11 and a pair of sleeves 12 with a V-neck portion at both the front and the rear, and a removable closure 15 at the anterior portion. To be remembered throughout the description is that the gown can be reversed for those patient situations requiring inspection of the posterior portion of the body. Also with spinal taps the posterior opening is desirable. The slight disadvantage of the posterior mode is that the patient himself cannot readily open and close the opening 15 particularly while lying in bed or sitting. The two sleeves 12 open at their upper portion 19, which permits a front quarter of the gown to be dropped for nursing or chest inspection. In many instances the mother will prefer to nurse with the shoulder portion 12 dropped.

Figure 3:
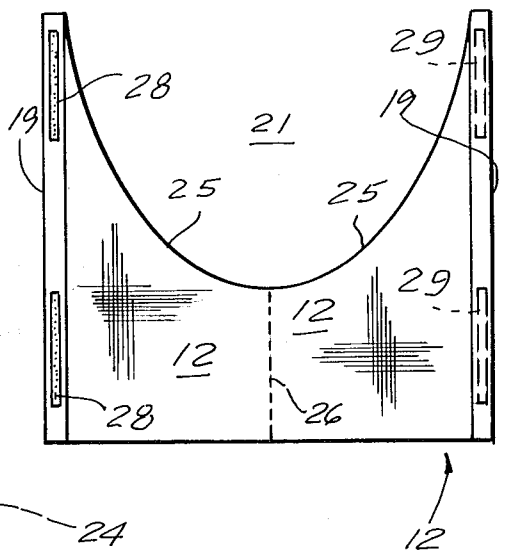
FIG. 3 is an inside plan view of the sleeve portion of which there are two.
Figure 4:
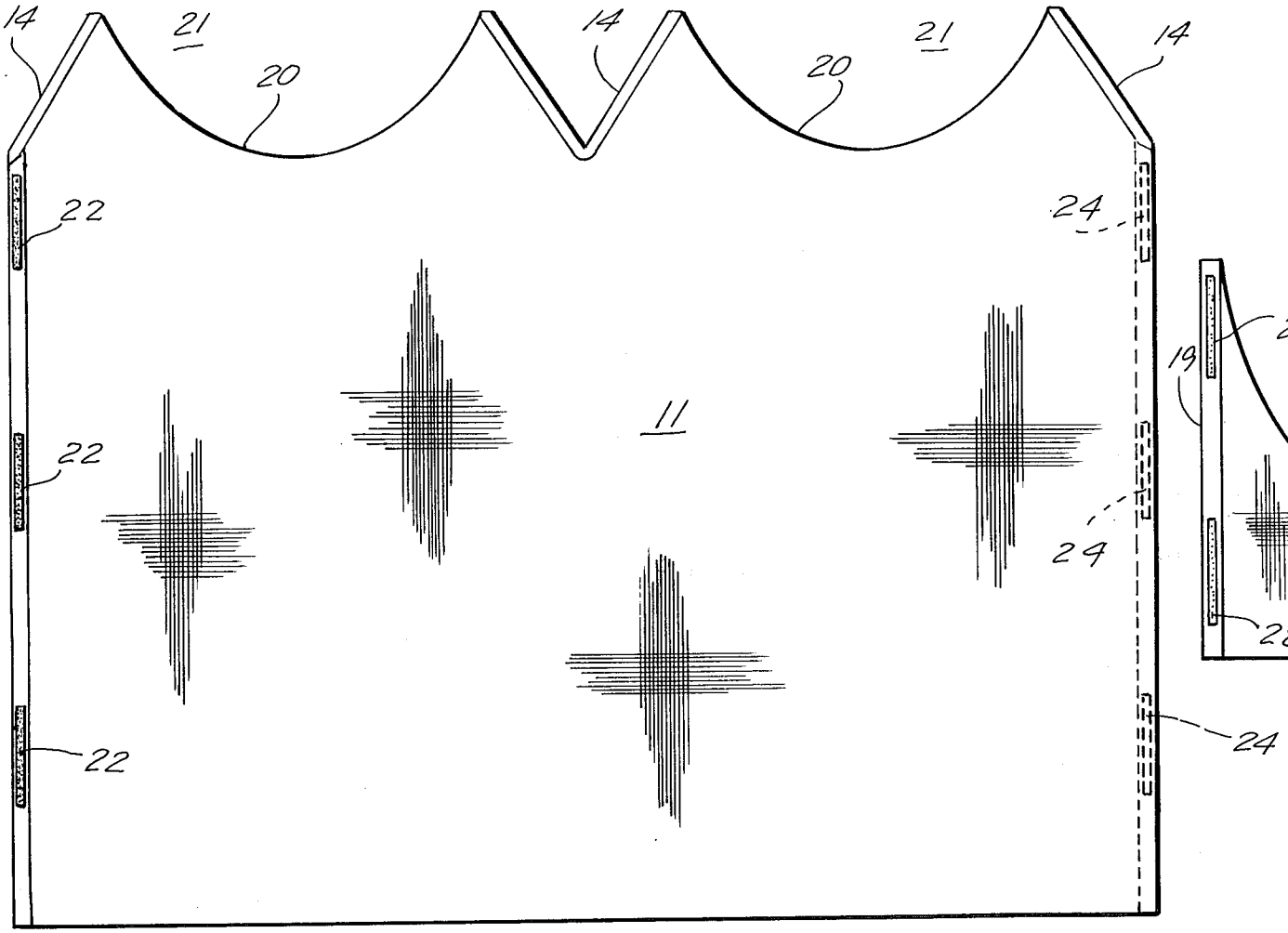
FIG. 4 is an inside plan view of the body portion of the gown prior to being closed.

Turning now to FIG. 3, it will be seen that the sleeve 12 is of such a configuration that it can be nested in a bolt of material in the sleeve connection 20 of the body 11 as shown in FIG. 4. The arm opening 21 between sleeve connection 20 in the body and sleeve connection 25 in the arm is provided at both portions of the upper reaches of the body 11, and desirably has a hem to secure the raw edge. Inside fasteners 22 are provided at at least three locations on the side of the body, and positioned to matingly engage the outside fasteners 24 to form the tubular body 11 on the patient. Thereafter only the connections on the sleeve upper portion opening 19 need to be secured and the gown is totally applied to the patient. The sleeves 12 are normally made of two pieces which are secured to the body at the U-shaped body connection 25. The underarm joint 26 is stitched for comfort and reinforcement. To be noted on the left-hand side of the inside of the sleeve 12 shown in FIG. 3 are the sleeve inside fasteners 28, at least two in number and at the opposite side the outside sleeve fasteners 29, also two in number.

Figure 5:
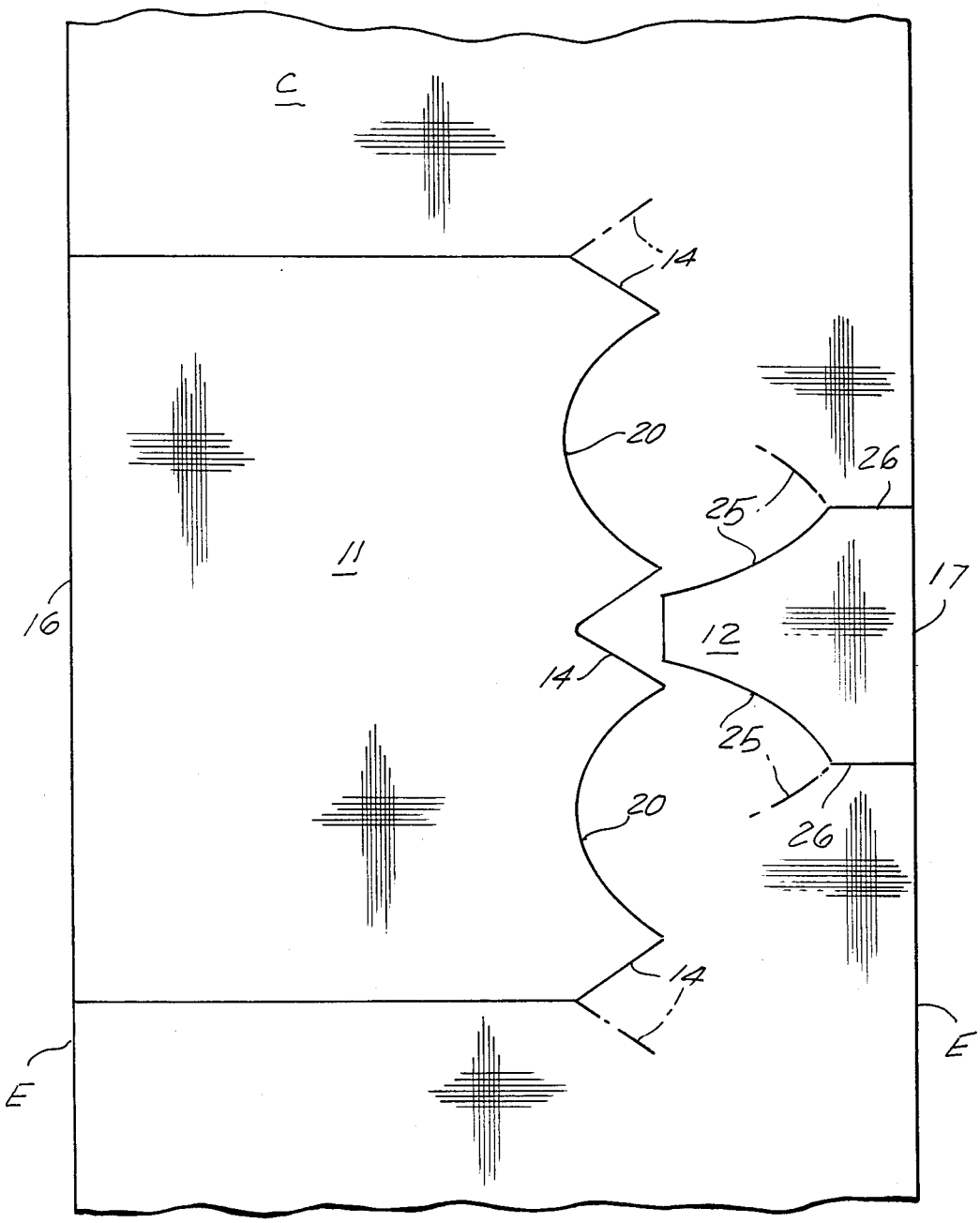
FIG. 5 shows in partially diagrammatic form a bolt of cloth and the way the body portion and sleeves are cut out of the cloth in order to utilize the finished edge of the cloth and eliminate hemming over a major portion of the gown.

While size does not limit the invention, the subject patient gown 10 can be readily cut out of a bolt of cloth approximately sixty inches wide, and finished to a fifty-six inch width. In addition, as noted in FIG. 5, the bolt of cloth C has the body 11 positioned on the bolt of cloth C so that the body base edge 16 is part of the finished edge E of the bolt of cloth. The finished edge does not require hemming. Also to be observed is that the parts of the sleeve 12 are cut out so that the sleeve outer edge 17 is also a part of the finished edge E. In this fashion the entire base of the garment as well as the entire outer portion of the sleeve require no further hemming or other treatment, thus reducing the labor content of the patient garment 10. The removable fasteners are desirably a mating stitch material known in the trade as VELCRO opposed pressure sensitive interlocking stitch fasteners. Snaps may be employed but are less desirable because they can irritate the patient's skin, and when laundered are not durable. On the other hand, where the patient is utilizing the garment in the anterior opening mode, this risk is minimized.

Further advantages and usages of the subject patient gown 10 are involved where cancer patients are receiving chemotherapy through intravenous feedings, Xray radiation to the chest area, or the abdominal area, and easy access through the anterior opening of the gown is important as well as the easy access to the sleeve. Furthermore, the patient is comforted and eased in the diagnostic examination by the physician, nurse, or other attending personnel.

As to the cardiac patient, the wearing of the electrodes connected to a cardiac monitor finds easy access through the anterior portion of the gown. Also the V-neck provides ease in movement for the patient. If the electrodes come off of the cardiac patient, they can easily be reattached due to the anterior opening, and perhaps only one of the segmented opening portions need to be accessed.

The intensive care patient will find the V-neck provides a safety measure particularly where a tracheostomy tube has been inserted. With a colostomy, the tube can be inserted through the gaps in the anterior portion, and the same is true with a gastrostomy. Patients having an arterial line inserted into either the jugular vein or the subclavian vein in the neck are easily accessed through the V-neck and the anterior opening. Similarly these life supporting lines can be monitored readily through the anterior opening in the gown by any attending person. With intensive care patients the V-neck leaves the critical portion of the neck and shoulder totally exposed, and in the preferred embodiment, on both the front and rear portion of the patient's neck and shoulder. While sleeping, the gown provides a great deal of mobility to the patient due to its simplicity, and as mentioned above, the lack of ties or knots behind the back which cause pressure points.

In pre-operation the anterior opening permits the preparation of the front portion of the body where most operations are performed. Such activity includes Xrays, prepping by shaving hair, applying local anesthetics and the like. The gown in the post-opeative condition permits easy inspection of the wound due to the segmented opening, and it provides an environment to maintain good sterile techniques. This reduces the possible contamination to the wound area when changing dressings. In addition it provides comfort, and particularly privacy to the patient. All of the above can tend to reduce hospital costs.

Finally, as to safety, patients will no longer through modesty or embarrassment suddenly grab the posterior portion of the gown to permit exposure of the buttocks and the like. With a patient who is not too steady in the ambulatory mode, this reduces the risk of falling, possibly breaking a hip and extending hospital days. For rehabilitation even in the home, or in a hospital environment, the same advantages apply. Of particular importance is the realization that with the anterior opening and the removable securement at the upper portion of the sleeve the patient can have his gown changed in almost the identical fashion as the top sheet of the bed. The only difference is with the top sheet of the bed it is wrapped around the mattress, whereas with this hospital gown it is wrapped around the patient.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What I claim is:

1. A patient gown comprising, in combination, a body portion formed from a single bilaterally symmetrical pattern piece, said pattern piece having identical front and rear symmetrical V-neck portions, a pair of sleeves, each formed from a bilaterally symmetrical pattern piece, said sleeves being closed at the bottom and secured to lateral upper opposed portions of the body piece, a single body opening depending from the base of one of the V-neck body portions, a single opening at the top of each sleeve portion, intermittent pressure sensitive opposed members secured to said openings to removably secure the same, at least two such pressure sensitive members securing each of the single body and two sleeve openings, one each of said pressure sensitive members being closely adjacent the neck intersection with the sleeve and body openings, whereby total reversibility of the garment is insured with securement at the neck draping areas with the opening for inspection and insertion of patient treatment elements through the openings.

2. The patient gown of claim 1, in which, said body opening has further fastening elements at a mid-portion and a lower portion.

3. The patient gown of claim 1, in which, the body base edge is the finished edge of a bolt of cloth, and the sleeve outer edge is a finished outer edge of a bolt of cloth, whereby hemming is rendered unnecessary for the entire body base edge and the sleeve outer edge.

* * * * *